US005366322A

United States Patent [19]

Hurwitt

[11] Patent Number: 5,366,322

[45] Date of Patent: Nov. 22, 1994

[54] APPARATUS FOR CONTAINMENT OF OVERFLOW AND RUNOFF WATER

[75] Inventor: Steven Hurwitt, Park Ridge, N.J.

[73] Assignee: Fresh Creek Technologies, Inc., Fairfield, N.J.

[21] Appl. No.: 103,199

[22] Filed: Aug. 9, 1993

[51] Int. Cl.[5] ..... E03F 1/00

[52] U.S. Cl. ..... 405/52; 405/210; 210/170; 210/747

[58] Field of Search ..... 405/36, 52, 53, 55, 405/210; 210/170, 320, 747

[56] References Cited

U.S. PATENT DOCUMENTS

| | | | |
|---|---|---|---|
| 2,924,350 | 2/1960 | Greer | 405/53 X |
| 3,516,568 | 6/1970 | Fish | 405/55 X |
| 3,605,774 | 9/1971 | Launay et al. | 405/210 X |
| 3,844,122 | 10/1974 | Bliss | 405/55 X |
| 3,958,424 | 5/1976 | Cotton | 405/55 |
| 4,047,390 | 9/1977 | Boyce | 405/210 X |
| 4,230,422 | 10/1980 | Brown et al. | 210/170 X |
| 4,298,471 | 11/1981 | Dunkers | 210/170 |
| 4,377,477 | 3/1983 | Dunkers | 210/170 |
| 4,735,524 | 4/1988 | Dunkers | 405/63 |

*Primary Examiner*—Randolph A. Reese
*Assistant Examiner*—John A. Ricci
*Attorney, Agent, or Firm*—Wood, Herron & Evans

[57] ABSTRACT

Apparatus for containment and/or equalization of effluent flow and runoff includes a plurality of compartments situated in a receiving body of water in a manner which prevents leakage of undiluted, polluted water into the receiving body of water. An inner, central compartment receives effluent flow or runoff and is surrounded or substantially surrounded by other compartments which allow sequential, generally radially outward flow of the effluent material from the central compartment to the receiving body of water. Leakage is further prevented through improved manners of sealing flexible wall compartments from water leakage under the lower edges of the compartment walls.

23 Claims, 2 Drawing Sheets

APPARATUS FOR CONTAINMENT OF OVERFLOW AND RUNOFF WATER

BACKGROUND OF THE INVENTION

The present invention generally relates to the treatment of polluted water and more specifically to apparatus and methods for containment and/or equalization of overflow water and runoff in a receiving body of water.

Flexible wall tanks contained within a body of water have been used as one manner of collecting and temporarily storing overflow, urban runoff and excess storm water flow. Examples of this type of apparatus are disclosed in U.S. Pat. Nos. 4,298,471 and 4,377,477 both issued to Dunkers. In these patents Dunkers discloses a tank formed by flexible walls extending from the surface to the bottom of a receiving body of water. The tank is divided into a series of compartments by intermediate walls. Apertures in the intermediate walls allow flow from compartment to compartment, with a first or inlet compartment receiving the polluted water inflow and a last compartment connecting with the surrounding body of water. This arrangement of sequentially connected compartments provides for progressive dilution of polluted inlet water before pollutants flow into the surrounding body of water.

The tank design disclosed by Dunkers, however, will allow leakage between the flexible outside walls of each compartment and the receiving body of water since a perfect seal cannot be maintained between the weighted lower edges of the compartment walls and the bottom or floor of the receiving body of water. This leakage allows insufficiently diluted, polluted water to pass underneath the outside walls of the various compartments and into the receiving body of water before the water has reached the final compartment. Although Dunker states that minor leakage is unimportant, public concern and environmental regulation now dictate that all such leakage must be considered important.

Flexible wall tanks have generally used weighted material integrated into the lower edges of the compartment walls or, alternatively, a series of weights attached along the lower edges of the compartment walls. In either case water is able to escape from the compartment underneath the compartment walls and into either an adjoining compartment which is not the next compartment in the dilution process or directly into the receiving body of water. In this regard, the weighted material which is integrated into the lower edge of a wall is not flexible enough to provide an adequate seal around debris such as rocks and other large objects on the bottom surface or floor of the receiving body of water. On the other hand, when a series of separate weights are attached along the lower edges of the compartment walls, water can escape beneath the lower edge of a wall at locations between adjacent weights.

SUMMARY OF THE INVENTION

Accordingly, it has been one object of the invention to minimize contamination of the receiving body of water through the use of an improved arrangement of tank compartments.

It has been another object of the invention to prevent significant leakage of water between the lower edges of the compartment side walls of a flexible wall tank and the bottom of the receiving body of water.

To these ends, the invention essentially comprises a plurality of concentrically arranged flexible wall tanks contained in a receiving body of water such as a lake. The innermost compartment is connected to an inlet for the overflow of water or urban runoff and the outermost compartment is in communication with the receiving body of water. Polluted water enters the innermost or inlet compartment of the tank through a conduit and travels sequentially through each of the remaining concentrically arranged compartments through gates in each compartment before finally exiting through the outermost compartment into the receiving body of water. Because the compartments are concentrically arranged, water which manages to leak from a particular compartment, for example, by passing beneath the flexible compartment wall, may only pass into an adjacent compartment. This adjacent compartment may only be the next compartment in the sequence, or the receiving body of water if that is the next step in the sequence, or the previous compartment in the sequence. In other words, by way of the present invention and as distinguished from prior flexible wall containment devices, polluted water cannot pass out of sequence from an earlier compartment in the sequence to a later compartment in the sequence.

An alternative embodiment of the invention comprises a plurality of tank compartments which surround a central inlet compartment on three sides. In this embodiment all the compartments include one common compartment wall which preferably has a more positive seal between the lower edge thereof and the bottom of the receiving body of water. This positive seal prevents the problems associated with allowing water to pass out of sequence into later compartments or the receiving body of water. The remaining compartment walls in this embodiment may be formed with less expensive and less positive seals such as those involving integrated weighted material or a series of weights since, like the first embodiment discussed above, any leakage past the remaining walls of the tank will be directed only into adjacent compartments in the flow sequence or into the receiving body of water if that is the next step in the sequence.

Further aspects of the invention contemplate improved sealing between the lower edges of the flexible compartment walls and the bottom of the receiving body of water. More specifically, one embodiment of the improved flexible compartment wall includes a lower edge having integrated therein alternating sections of a weight material and a highly flexible nonbuoyant material such as open cell foam. Thus, the integrated weight material maintains the lower edge of the compartment wall against the bottom of the receiving body of water while the integrated flexible material allows the lower edge to easily flex around and over debris, such as rocks and the like, to maintain a more positive seal between the lower edge of the wall and the floor of the receiving body of water.

A second embodiment of the flexible compartment wall includes a lower edge having weights or weighted material thereon and further includes a lower skirt attached above the lower edge of the wall and having weights or weighted material along a lower edge thereof for providing an additional seal between the wall and the floor of the receiving body of water. The skirt and the lower portion of the wall define a buffer zone of water therebetween to further prevent leakage of water from one compartment to another.

A third embodiment of the invention incorporates an integral bottom wall which is sealed to the lower edges of the compartment side walls to form a leakproof compartment. The bottom wall is preferably formed of a flexible material and incorporates weights or ballast material for maintaining the bottom wall on the floor of the receiving body of water.

Additional objects and advantages of the invention will become more readily apparent from the following detailed description taken in conjunction with the accompanying drawings.

DETAILED DESCRIPTION OF THE PREFERRED EMBODIMENTS

Figure 1:
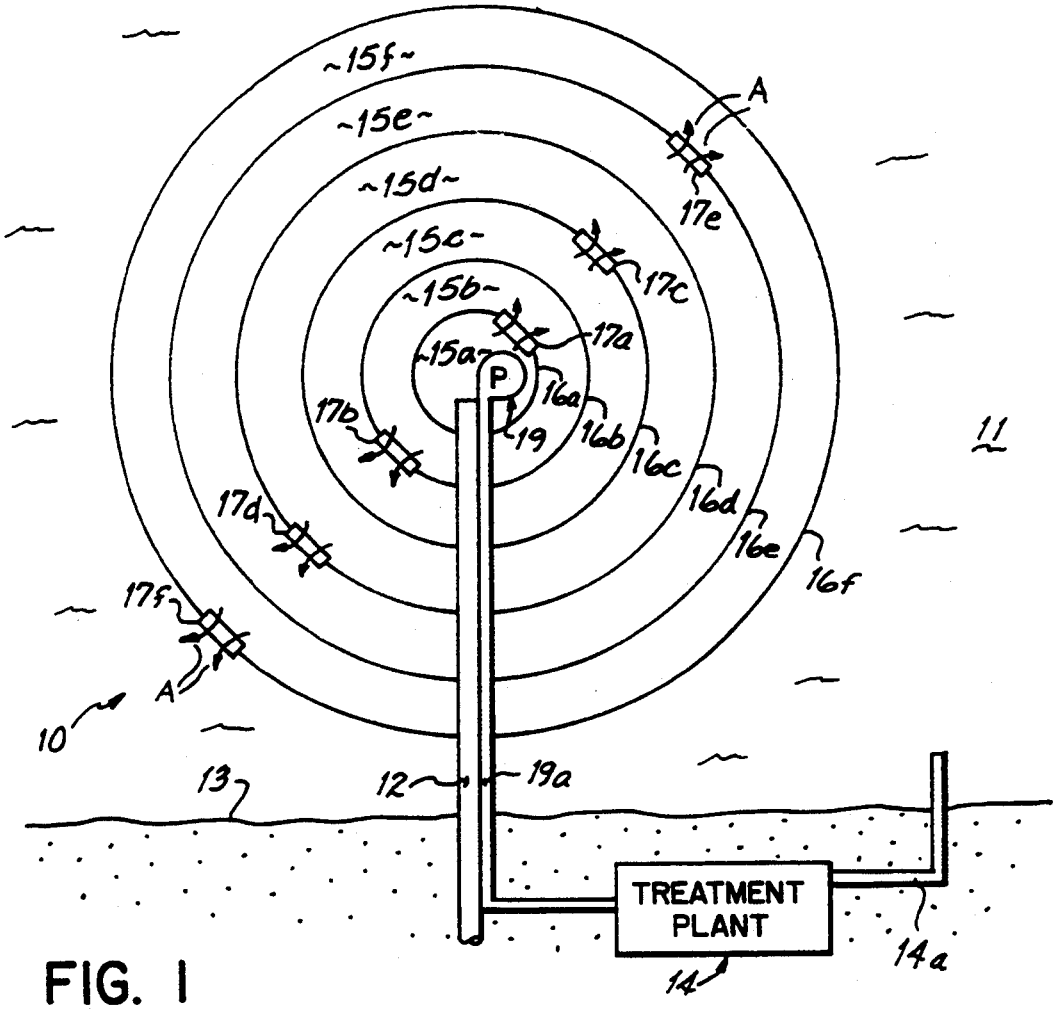
FIG. 1 shows a top view of a preferred tank design of the invention.

A preferred embodiment of the invention is shown in FIG. 1 and comprises a flexible wall tank 10 situated in a receiving body of water 11 such as a lake. Effluent material such as runoff water flows through a delivery pipe 12 extending from the shoreline 13 and leading to a central inlet compartment 15*a* of the tank 10. The tank further includes a plurality of concentric compartments 15*b*–15*f* surrounding the central inlet compartment 15*a*. Each respective concentric compartment 15*a*–15*f* is enclosed by flexible side walls 16*a*–16*f* which extend generally vertically from the bottom of the receiving body of water 11 to the surface thereof and are preferably formed of waterproof plastic sheet material. It will be appreciated that, as is well known in the art, support structure will be necessary to hold the flexible walls of the present: invention in a vertical orientation. For purposes of clarity, this support structure has not been shown in the drawings.

The compartment side walls 16*a*–16*f* each include respective gates 17*a*–17*f* for allowing effluent material to pass from the central inlet compartment 15*a* sequentially into each of the remaining compartments 15*b*–15*f* and finally from the outermost compartment 15*f* into the receiving body of water 11 all as shown by the arrows designated "A". Since the gates contained in adjacent compartment side walls are located diametrically opposite to one another, complete dilution within each compartment 15*a*–15*f* takes place before the effluent material leaves one compartment and enters another compartment or the receiving body of water. Moreover, effluent material entering compartment 15*a* from delivery pipe 12 can only pass into the next sequential compartment 15*b* whether flow is through the intended gate 17*a* or through an imperfect lower seal in the compartment side wall 16*a*. Similarly, effluent material contained in all of the remaining concentric compartments 15*b*–15*f* can only pass into an adjacent compartment in the sequence or, in the case of water contained in the outermost compartment 15*f*, into the receiving body of water 11. Thus, for example, effluent material cannot pass out of sequence from compartment 15*b* into compartments 15*d*, 15*e*, or 15*f*, or into the receiving body of water 11.

As further shown in FIG. 1, an immersible pump 19 is preferably located in the central inlet compartment 15*a* and supplies a treatment plant 14 via a conduit 19*a*. The treated water is taken from the treatment plant 14 via a discharge conduit 14*a* to the receiving body of water 11. The function and purpose of the pump 19 is well known and disclosed, for example, in U.S. Pat. No. 4,377,477 to Dunkers which is expressly incorporated herein by reference.

The concentric design of the tank 10 eliminates the need for difficult shoreline seals and guarantees sequential flow through all compartments 15*a*–15*f*. The term "concentric" as used herein to describe the arrangement of the compartments 15*a*–15*f* is intended to encompass overall shapes of the tank 10 other than the circular design shown in FIG. 1. These alternative shapes may be square, rectangular or other polygonal shapes, for example, depending on the particular application requirements. In any case it is only necessary that the arrangement of compartments be such that the inner compartment is completely surrounded by outer compartments which assure sequential flow of the effluent material to the receiving body of water 11.

Figure 2:
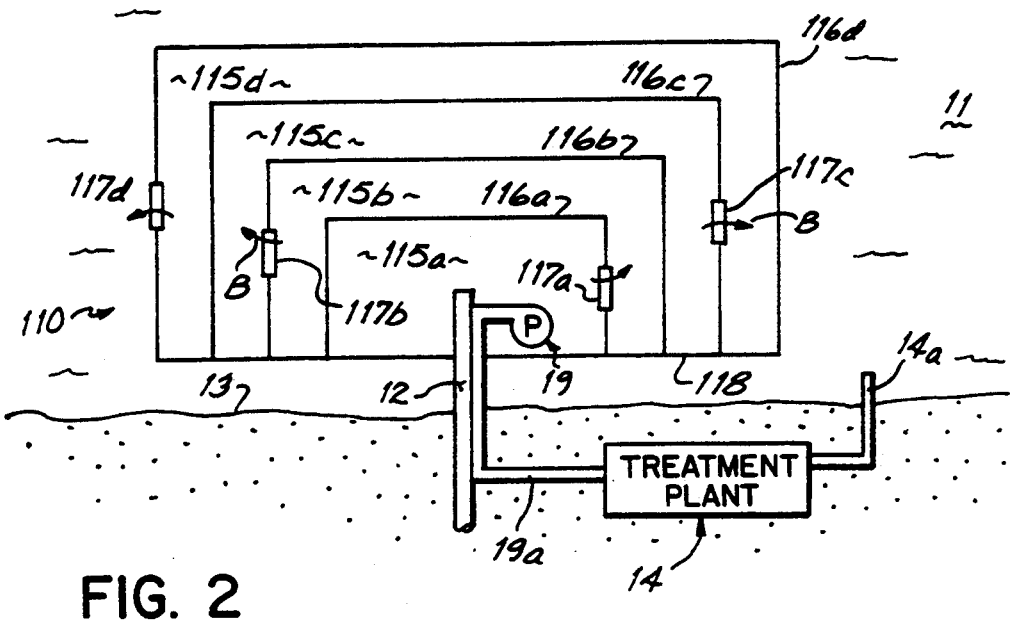
FIG. 2 shows a top view of a tank design according to a second embodiment of the invention.

An alternative tank design 110 is illustrated in FIG. 2. The tank 110 is situated in a receiving body of water 11 such as a lake effluent material such as runoff water is fed through a delivery pipe 12 extending from the shoreline 13 into a central inlet compartment 115*a*. The central inlet compartment 115*a* is enclosed on all sides except one by a vertical side wall 116*a*. The inlet compartment 115*a* is surrounded on all sides but one by further compartments 115*b*–115*d*. Each of the compartments 115*a*–115*d* includes one common vertical side wall 118 which may abut and seal against the shoreline 13. The compartments 115*a*–115*d* further include gates 117*a*–117*d* which allow sequential passage of effluent material between the compartments 115*a*–115*d* in the direction of the arrows "B".

Like the embodiment of FIG. 1, the inlet compartment 115*a* includes an immersible pump 19 preferably located in the central inlet compartment 115*a* and supplies a treatment plant 14 via a conduit 19*a*. The treated water is taken from the treatment plant 14 via a discharge conduit 14*a* to the receiving body of water 11.

Although this design would normally be susceptible to nonsequential flow of effluent material by leakage beneath the common side wall 118, the tank 110 assures sequential flow of effluent material through the tank 110 where a positive shoreline seal of the common wall 118 is possible. Thus, when such a positive shoreline seal is easily attainable it may be desirable to utilize this adaptation of the concentric design of FIG. 1. Such a positive seal between the lower edge of the common side wall 118 and the floor of the receiving body of water 11 may, for example, be obtained by using one of the improved compartment wall lower edge constructions described below in connection with FIGS. 3–5.

It will be appreciated that once a positive seal between the lower edge of the common vertical side wall 118 and the floor of the receiving body of water or shoreline has been established, the arrangement of compartments 115*a*–115*d* assures sequential flow of effluent material from the inner compartment 115*a* to the receiving body of water 11. In this regard, effluent material entering compartment 115*a* from delivery pipe 12 can only pass into the next sequential compartment 115*b* whether flow is through the intended gate 117*a* or through an imperfect bottom seal in the compartment side wall 116*a*. Similarly, effluent material contained in all of the remaining concentric compartments 115*b*–15*d* can only pass into an adjacent compartment in the sequence or, in the case of water contained in the outermost compartment 115*d*, into the receiving body of water 11. Thus, for example, effluent material cannot pass out of sequence from compartment 115*a* into compartments 115*c* or 115*d*, or into the receiving body of water 11.

The gates 117*a*–117*d* are located, as in the first embodiment, such that maximum dilution occurs before the effluent material leaves one compartment and sequentially enters either the next compartment or the receiving body of water 11. That is, since the gates contained in adjacent compartment side walls are located a significant distance from one another, complete dilution within each compartment 115*a*–115*d* takes place as a result of the effluent material having to travel a significant distance within the compartment before leaving the compartment.

Figure 3:
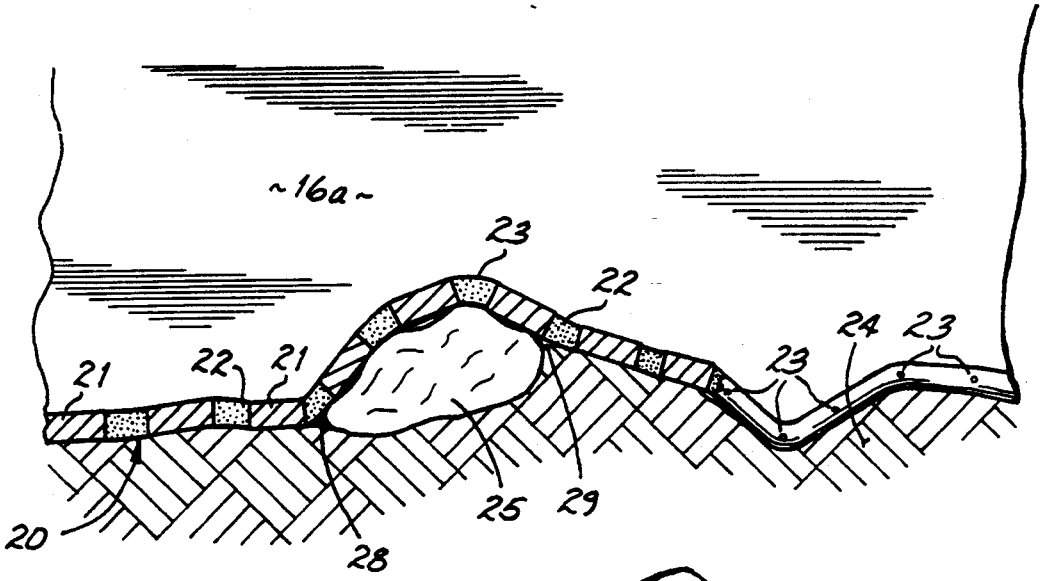
FIG. 3 is a side view partially in cross section showing one embodiment of the lower sealing edge of a compartment wall of the invention.

FIG. 3 illustrates one embodiment of a compartment side wall, which may be any compartment side wall of either tank 10 or 110 but for illustrative purposes is shown as side wall 16*a*, having an improved sealing lower edge 20. The lower edge 20 is weighted to provide a seal between the wall 16*a* and the floor 24 of the receiving body of water 11. The lower edge 20 is also constructed to be highly flexible and compliant such that it more readily follows the irregular contour of the floor 24 and the contour of debris such as rocks 25 which project upwardly from the floor 24.

The lower edge 20 includes alternating weighted segments 21 and highly flexible segments 22. The weighted segments 21 may be preformed from metal, concrete or other nonbuoyant heavy materials, or alternatively, may be sand, gravel, rock, or bottom silt used in bulk form contained within a seam at the lower edge 20. The highly flexible segments 22 are preferably formed from open celled foam contained within a seam at the lower edge 20. One or more apertures 23 are formed in the seam at the lower edge 20 to allow for escape of entrapped air which would reduce the effect of the weighted segments 21 by providing unwanted buoyancy, and to permit saturation of the open celled foam segments 22 with water. The compliancy of the lower edge 20 allows a more positive bottom seal to be obtained by significantly reducing the size of or eliminating gaps 28, 29 which would otherwise form when the lower edge 20 lays on an irregularly shaped bottom floor of the receiving body of water 11, for example, having large debris such as rocks 25.

Figure 4:
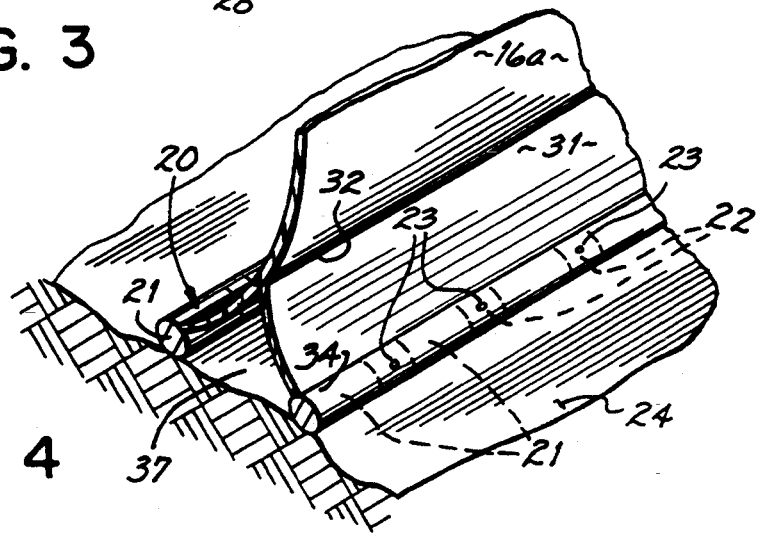
FIG. 4 is a perspective view of a second embodiment of the lower sealing edge of a compartment wall of the invention; and, FIG. 5 is a perspective view of another embodiment of the invention having an integral bottom wall formed as part of each compartment.

FIG. 4 shows another embodiment of the lower edge portion of a compartment wall 16*a*, which may form any one or all of the compartment side walls of the tanks 10, 110 of the present invention. In this embodiment a flexible skirt 31 is attached along a junction 32 extending along a lower portion of the wall 16*a*. The skirt 31 is preferably formed of plastic sheet material and attached to the wall 16*a* by, for example, heat sealing along the junction 32. The lower edge 20 of the compartment wall 16*a* and the lower edge 34 of the skirt 31 each include weight material 21 which may be contained within respective lower seams of the wall 16*a* and the skirt 34. Each of these weighted lower edges 20, 34 are also preferably constructed according to the embodiment of FIG. 3 to include flexible segments 22 formed of open celled foam so as to make the lower edges 20, 34 highly compliant and flexible to conform to the irregular contour of the floor 24 of the body of water 11. A buffer volume or zone 37 of water is defined between a lower portion of the compartment side wall 16*a* and the skirt 31 to further reduce leakage.

Figure 5:
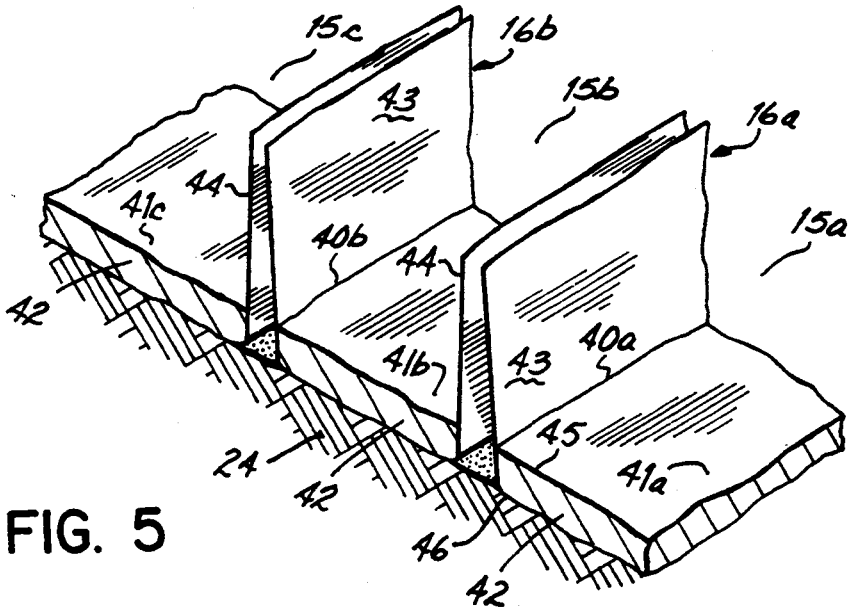

Another manner of preventing leakage of effluent material from a compartment is illustrated in FIG. 5. Again, although only three compartments 15*a*–15*c* are shown for illustrative purposes, it will be understood that the concepts employed in any flexible tank design. According to this embodiment, lower edges 40*a*, 40*b* of the respective compartment walls 16*a*, 16*b* are sealed to flexible bottom walls 41*a*, 41*b* which include ballast or weight material 42 for maintaining the bottom walls 41*a*, 41*b* on the floor 24 of the receiving body of water 11. The compartment side walls 16*a*, 16*b* are preferably double sheet walls. By way of this design, one sheet 43 of wall 16*a* is sealed to the bottom wall 41*a* of compartment 15*a* at the lower edge 40*a* thereof and the other sheet 44 is sealed to the bottom wall 41*b* of compartment 15*b* at the lower edge thereof. In the same manner, one sheet 43 of wall 16*b* is sealed to the bottom wall 41*b* of compartment 15*b* along the lower edge 40*b* thereof and the other sheet 44 is sealed to the bottom wall 41*c* of compartment 15*c* at the lower edge thereof. Ballast or weight material 42 is preferably sealed between an upper surface 45 and a lower surface 46 of each bottom wall 41*a*, 41*b*, 41*c*.

Although preferred embodiments of the invention have been shown and described above in detail, numerous structural and material substitutions and other design modifications fully encompassed by the teachings of the present invention will become readily apparent to those of ordinary skill. For example, the number of compartments in the tanks 10, 110 may, of course, be varied according to the specific needs of the locale. Also, the individual compartments of the tanks 10, 110 could be broken up into subsections with inner subsections being in fluid communication with outer, adjacent subsections. Although less efficient, the leakage problem addressed by the present invention would be solved as long as the subsections of a given compartment in the tank 10 aggregate to fully surround the adjacent, inner compartment and so on. In the case of the tank 110, the subsections of a given compartment would aggregate to surround the adjacent, inner compartment except around the side connected to the common wall 118.

Numerous other modifications will become readily apparent and applicant therefore intends to be bound not by the specific details disclosed herein as preferred embodiments but by the scope of the claims appended hereto.

I claim:

1. An apparatus for containing the flow of effluent material comprising a tank having a plurality of compartments defined by compartment side walls adapted to extend from the bottom of a receiving body of water to the surface thereof, said plurality of compartments including a central inner compartment for communicating with an effluent discharge conduit and at least one outer compartment which surrounds said inner compartment, said compartment side walls formed of a flexible material which is incapable of self-support and which includes weighted material along lower edges thereof for holding said lower edges against and conforming said lower edges to an irregular contour of the bottom of the receiving body of water, said side walls further including gates for allowing fluid communication between said inner and outer compartments and between said outer compartment and said receiving body of water.

2. The apparatus of claim 1 further comprising at least one intermediate compartment located between said inner and outer compartments, said intermediate compartment surrounding said inner compartment and being surrounded by said outer compartment and further being in fluid communication with said inner and outer compartments.

3. The apparatus of claim 2 further comprising a plurality of intermediate compartments, wherein adjacent compartments are in fluid communication within one another.

4. The apparatus of one of claims 1, 2, or 3 wherein said lower edges further comprise a plurality of weighted segments interspersed with a plurality of compressible, flexible segments.

5. The apparatus of claim 4 wherein said compressible, flexible segments comprise segments of open celled foam attached to said lower edges and adapted to be in fluid communication with the receiving body of water.

6. The apparatus of one of claims 1, 2, or 3 wherein said compartment side walls each further include a skirt attached and extending along a lower portion thereof, each skirt being formed of a flexible material and including weighted material along lower edges thereof for holding said lower edges against the bottom of the receiving body of water and creating a buffer zone of water between said compartment side wall and said skirt.

7. The apparatus of claim 1 wherein said compartment side walls of each compartment are attached in a fluid tight manner to a set of flexible bottom walls containing ballast material therebetween and adapted to lie on the bottom of said receiving body of water for completely sealing each compartment along lower portions thereof from said receiving body of water.

8. The apparatus of claim 1 further comprising a pump for withdrawing polluted water from said inner compartment.

9. An apparatus for containing the flow of effluent material comprising a tank having a plurality of compartments defined by compartment side walls adapted to extend from the bottom of a receiving body of water to the surface thereof, said plurality of compartments including a central inner compartment for communicating with an effluent discharge conduit and at least one outer compartment which substantially surrounds said inner compartment and includes one compartment side wall in common with said inner compartment, said compartment side walls formed of a flexible material which is incapable of self-support and which includes weighted material along lower edges thereof for holding said lower edges against and conforming said lower edges to an irregular contour of the bottom of the receiving body of water, said side walls further including gates for allowing fluid communication between said inner and outer compartments and between said outer compartment and said receiving body of water.

10. The apparatus of claim 9 further comprising at least one intermediate compartment located between said inner and outer compartments, said intermediate compartment substantially surrounding said inner compartment and being substantially surrounded by said outer compartment and further being in fluid communication with said inner and outer compartments and including a common side wall with said inner and outer compartments.

11. The apparatus of claim 10 further comprising a plurality of intermediate compartments, wherein adjacent compartments are in fluid communication within one another and each compartment includes a common side wall.

12. The apparatus of claim 9 wherein said lower edges further comprise a plurality of weighted segments interspersed with a plurality of compressible, flexible segments.

13. The apparatus of claim 12 wherein said compressible, flexible segments comprise segments of open celled foam attached to said lower edges and adapted to be in fluid communication with the receiving body of water.

14. The apparatus of claim 9 wherein said compartment side walls each further include a skirt attached and extending along a lower portion thereof, each skirt being formed of a flexible material and including weighted material along lower edges thereof for holding said lower edges against the bottom of the receiving body of water and creating a buffer zone of water between said compartment side wall and said skirt.

15. The apparatus of claim 9 wherein said compartment side walls of each compartment are attached in a fluid tight manner to a bottom wall adapted to lie on the bottom of said receiving body of water for completely sealing each compartment along lower portions thereof from said receiving body of water.

16. The apparatus of claim 9 further comprising a pump for withdrawing polluted water from said inner compartment.

17. In a flexible compartment side wall of an apparatus for containing the flow of effluent material, said compartment side wall adapted to extend from the bottom of a receiving body of water to the surface thereof and including weight segments attached along lower edges thereof, the improvement comprising:

a plurality of compressible, flexible segments attached to said lower edges of said compartment side walls and interspersed with said weight segments.

18. The apparatus of claim 17 wherein said compressible, flexible segments comprise segments of open celled foam attached to said lower edges and adapted to be in fluid communication with the receiving body of water.

19. The apparatus of claim 18 wherein said segments of open celled foam alternate with said weight segments along said lower edges.

20. In a flexible compartment side wall of an apparatus for containing the flow of effluent material, said compartment side wall adapted to extend from the bottom of a receiving body of water to the surface thereof and including weight segments attached along lower edges thereof, the improvement comprising:

a skirt attached and extending along a lower portion of said compartment side wall, said skirt being formed of a flexible material and including weighted material along lower edges thereof for holding said lower edges against the bottom of the receiving body of water and creating a buffer zone of water between said compartment side wall and said skirt.

21. In an apparatus for containing the flow of effluent material, including a plurality of compartment side walls adapted to extend from the bottom of a receiving body of water to the surface thereof and forming a plurality of compartments having gates for allowing sequential flow of effluent material from an inlet compartment which receives effluent discharge to an outlet compartment which communicates with said receiving body of water, the improvement comprising:

a flexible bottom wall attached in a fluid tight manner to compartment side walls in each of said plurality of compartments, said flexible bottom wall including weight material for maintaining said bottom wall on the bottom of said receiving body of water.

22. An apparatus for containing the flow of effluent material comprising a tank having a plurality of compartments defined by compartment side walls adapted to extend from the bottom of a receiving body of water to the surface thereof, said plurality of compartments including a central inner compartment for communicating with an effluent discharge conduit and at least two outer compartments which surround said inner compartment, said compartment side walls including gates therein for allowing fluid communication between said inner and outer compartments and between one outer compartment and said receiving body of water, wherein gates in compartment side walls of adjacent compartments are remotely disposed relative to one another such that fluid traveling from said inner compartment through said outer compartments must travel through a substantial portion of each of said outer compartments before exiting into said receiving body of water.

23. An apparatus for containing the flow of effluent material comprising a tank having a plurality of compartments defined by compartment side walls adapted to extend from the bottom of a receiving body of water to the surface thereof, said plurality of compartments including a central inner compartment for communicating with an effluent discharge conduit and at least two outer compartments which substantially surround said inner compartment, each outer compartment including one compartment side wall in common with said inner compartment, said compartment side walls including gates therein for allowing fluid communication between said inner and outer compartments and between one outer compartment and said receiving body of water, wherein gates in said compartment side walls are remotely disposed relative to one another such that fluid traveling from said inner compartment through said outer compartments must travel through a substantial portion of each outer compartment before exiting into a receiving body of water.

* * * * *